United States Patent [19]

Waldrum

[11] 4,051,805

[45] Oct. 4, 1977

[54] CAN WASHING AND COATING SYSTEM

[75] Inventor: John E. Waldrum, Ambler, Pa.

[73] Assignee: Amchem Products, Inc., Ambler, Pa.

[21] Appl. No.: 630,822

[22] Filed: Nov. 11, 1975

[51] Int. Cl.[2] ..... B05C 7/02

[52] U.S. Cl. ..... 118/58; 118/73; 118/314; 118/315; 118/318; 118/319; 118/323; 134/66; 134/152; 134/170

[58] Field of Search ..... 118/319, 318, 320, 317, 118/321, 313, 314, 73, 315, 58, 323; 134/66, 134, 152, 170; 34/105; 198/103, 22 B

[56] References Cited

U.S. PATENT DOCUMENTS

| | | | |
|---|---|---|---|
| 1,055,220 | 3/1913 | Pindstofte | 134/152 X |
| 1,747,517 | 2/1930 | Libbey | 118/319 |
| 2,184,100 | 12/1939 | Mondloch | 134/66 X |
| 2,244,651 | 6/1941 | Goebel et al. | 118/319 X |
| 2,512,651 | 6/1950 | Jacobs | 118/319 X |
| 2,936,798 | 5/1960 | Cummings et al. | 198/103 X |
| 3,226,757 | 1/1966 | Shea | 134/81 X |
| 3,620,813 | 11/1971 | Minboile, Jr. et al. | 118/73 X |
| 3,850,096 | 11/1974 | Taniguchi | 198/22 B X |

*Primary Examiner*—John P. McIntosh
*Attorney, Agent, or Firm*—Caesar, Rivise, Bernstein & Cohen, Ltd.

[57] ABSTRACT

A system for cleaning, rinsing, coating and drying cans having a circular side wall and a closed end wall at a high rate of speed as the cans emerge from the apparatus by which they are formed. The system basically comprises a washing stage, at least one rinsing stage and a drying stage, with one or more coating stages provided if desired. Each stage is housed in its respective housing and having a can entrance location and a can exit location, with the exit location of one stage being connected to the entrance location of the next succeeding stage by conveyor means. The stages are of a generally similar construction and basically comprise a carrier assembly disposed within the housing for receipt of the formed cans. The carrier rotates about a main longitudinal axis for carrying the cans from the entrance location to the exit location through a circular orbit and in planetary motion, wherein the cans are rotated about their own longitudinal axis as they orbit about the main longitudinal axis of the housing. Reciprocating spray means are provided to reciprocate into and out of the cans as they orbit to spray the interior of the cans while stationary spray means disposed adjacent to the orbit path spray the closed end of the cans as they orbit. Other rotating spray means is disposed about the main longitudinal axis of the housing to radially direct spray at the circular outside walls of the cans as they orbit.

23 Claims, 14 Drawing Figures

FIG.8
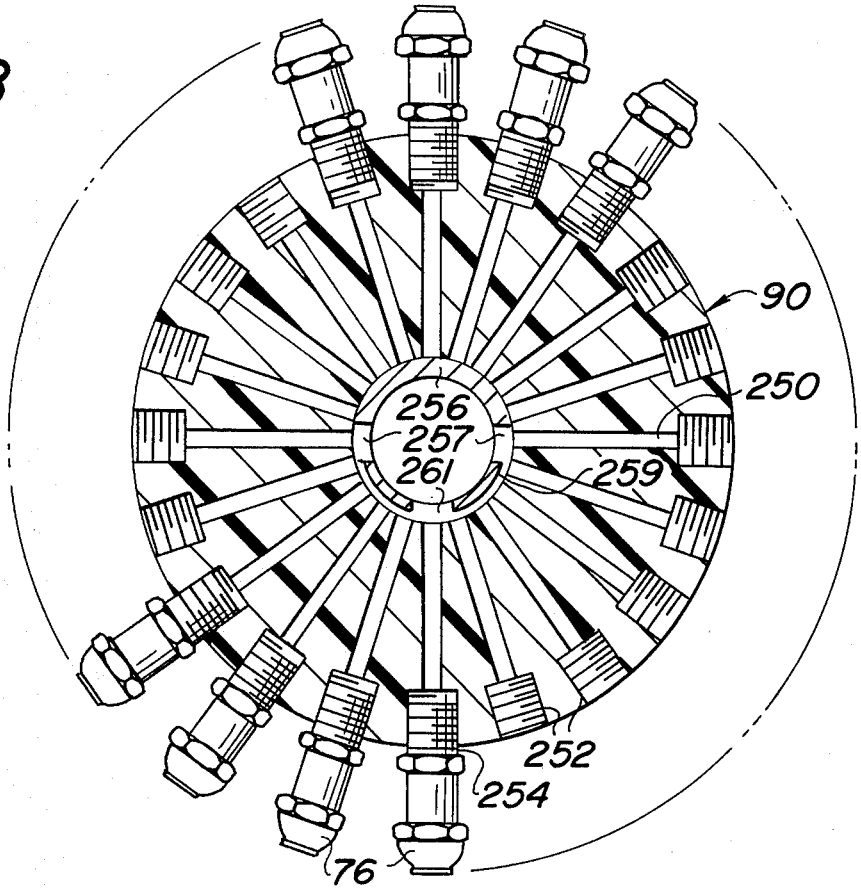
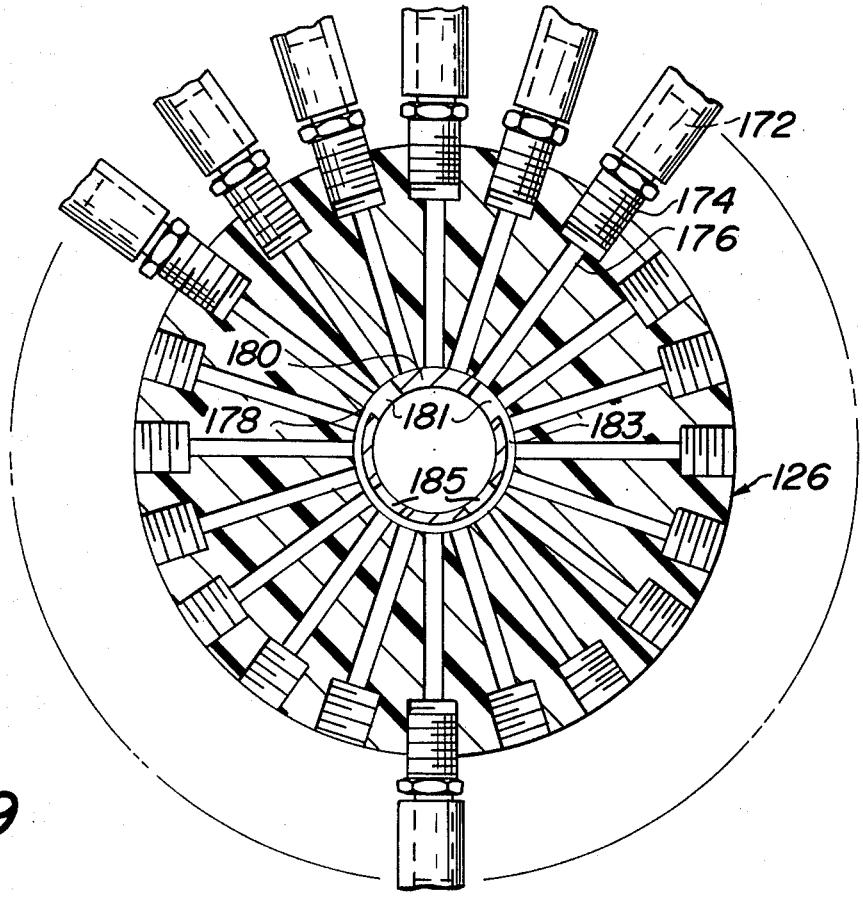
FIG. 9

FIG. 12
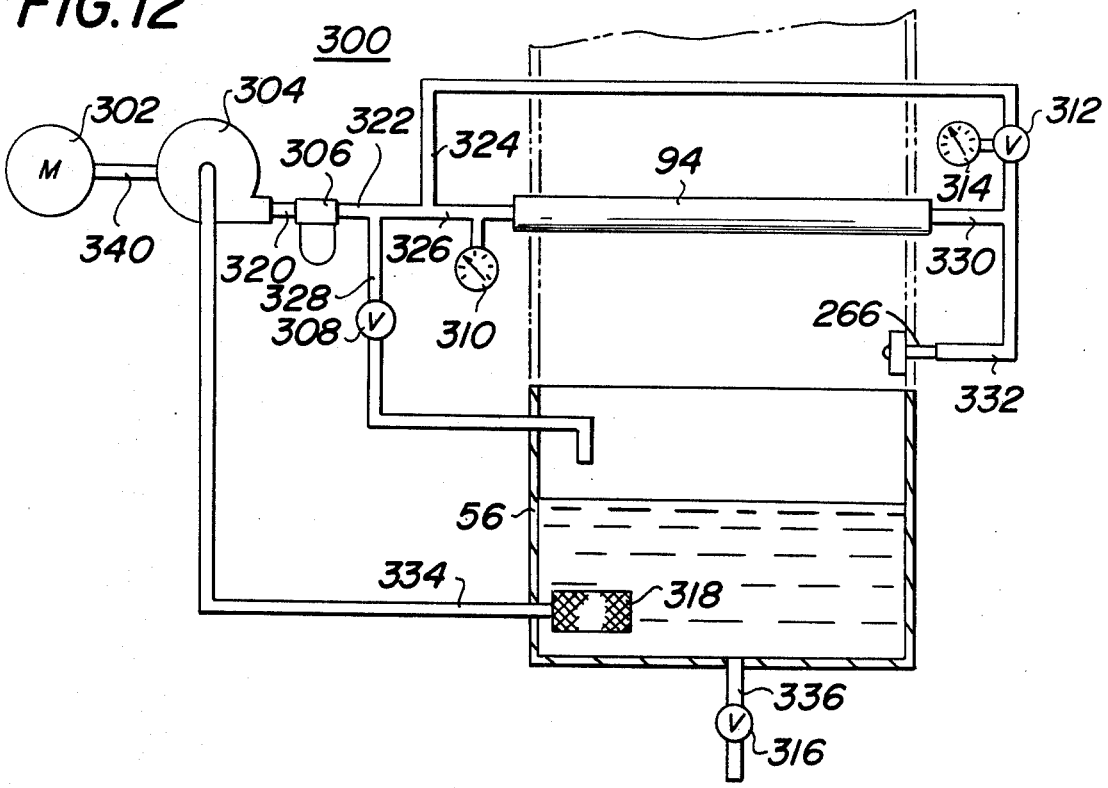
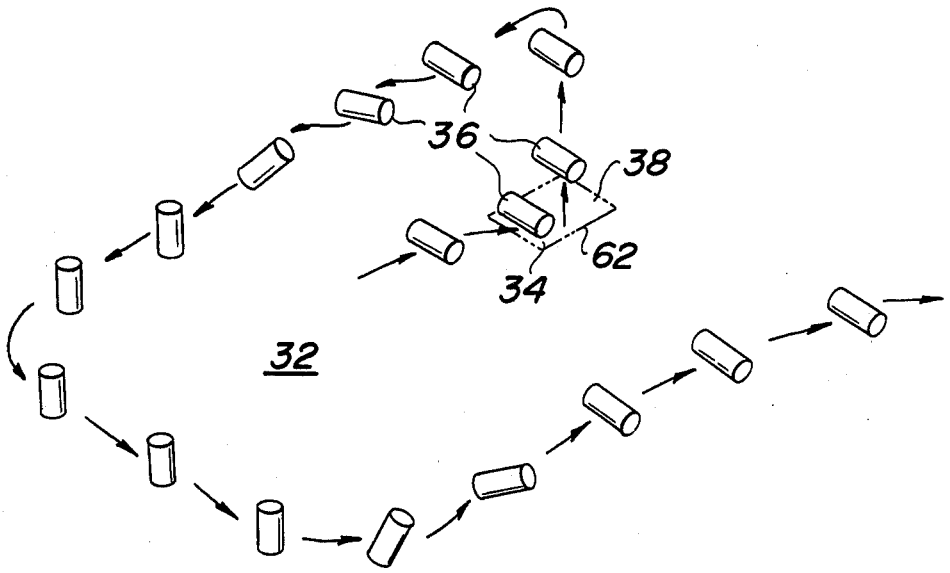
FIG. 13

CAN WASHING AND COATING SYSTEM

This invention relates generally to apparatus for cleaning the interior and exterior surface of containers and more particularly to a system for cleaning and drying newly formed cans.

A recent development in the can forming art has been the use of apparatus for forming cans as an integral unit and without any side seams to be joined such as by soldering. Such apparatus is generally referred to as a Drawing and Ironing apparatus or a D & I apparatus, and is arranged to form in a single step an integral can body comprising a seamless circular side wall and an end wall connected thereto. To that end, a lump of metal, such as aluminum, is inserted between the dies of the D & I machine and is quickly upset therein to form the can body. While such apparatus are a significant advancement over prior art equipment and techniques for forming cans, the cans produced thereby are invariably "dirty", that is, they have an oil film and other surface impurities, such as metal particles and the like, dispersed over their interior and exterior surfaces. Such surface impurities must be cleaned off of the cans to ready the cans for subsequent operations, such as chemical coating and lithography or labelling. Accordingly, in modern can forming plants apparatus is provided downstream of the D & I apparatus to remove oil films and other surface impurities from the can surfaces to thereby prepare the cans for subsequent treating operations such as coating, lithography, labelling, filling, etc.

Heretofore, commonly used prior art can cleaning apparatus could be considered to be merely a glorified automated "car wash" in that they basically comprised a conveyor system (e.g., a belt) for moving plural cans through a spray washer and rinser and thereafter through a dryer. The spray washer directs a relatively low pressure (e.g., 20 to 30 p.s.i.) cleaning liquid spray at the cans moving therethrough to wash the impurities off the cans. The washed cans are rinsed by spraying a rinsing liquid at the cans, again at a relatively low pressure. Once rinsed, the cans are dryed by passage through either a drying chamber or by a hot air blast directed thereon. U.S. Pat. No. 3,262,460 (Huddle) discloses one such "car wash type" can cleaning system. In that patent a system is disclosed wherein plural cans to be cleaned are supported in an inverted position on a constantly moving perforated conveyor and are sprayed by a series of sprays as they advance along the conveyor. This system is disclosed as operating at speeds which will process approximately 240 cans per minute.

While such systems are generally effective for providing cans ready for postforming treatment, they nevertheless exhibit various drawbacks. One particularly aggravating drawback of such systems is that the rinsing liquid droplets remaining on the cans as the cans pass into the drying stage, dry rather slowly, leaving residue spots on the surface of the cans in their place. Such residue spots may interfere with the subsequent coating and lithography operations. Another serious drawback of prior art "car wash" can cleaning systems is that such systems operate rather slowly. While this drawback may not have been significant prior to the introduction of high speed lithographic apparatus, it is significant now. Today, state-of-the-art can lithography apparatus are capable of operation at rates up to eight hundred cans per minute and such speeds are approximately twice the highest speed of the "car wash" type can cleaning and drying systems. Accordingly, such systems serve as a bottleneck in can forming plants.

Various systems, other than the "car wash" type of can cleaning and drying system heretofore described, have been proposed for cleaning newly formed cans. However, such systems have not met with complete success due to various inherent drawbacks in such systems, e.g., complexity, cost, reliability, efficiency and speed of operation. Among the various prior art apparatus and techniques for cleaning cans are the following:

U.S. Pat. No. 1,833,007 (Taylor) discloses an extremely complex and bulky can washing systems wherein the cans are received in respective recesses provided along the periphery of a conveyor belt.

U.S. Pat. No. 3,291,143 (Huddle) discloses a can cleaning system including a moving conveyor travelling above the tops of the cans being cleaned, which cans are inverted. Spray heads are provided underlying the inverted cans and are arranged to lift the cans upward so that the uppermost ends of the cans contact the overlying conveyor and are caused to advance by reason of their contact with the moving conveyor.

U.S. Pat. No. 3,353,515 (Stolle et al.) discloses a can washing system including a cabinet forming a sinuous course through which the cans to be cleaned travel. Each can is carried in intermittent motion by a respective can holder. Fluid jets are arranged to spray the entire surface of the can, with the spraying action occurring during the rest period between the movement of the cans.

U.S. Pat. No. 3,107,677 (Romine et al.) discloses a system for cleaning cans and comprising a circulating sprocket drive chain having projection extending therefrom for supporting respective cans thereon. Various angularly directed spraying nozzles are stationarily mounted with respect to the path through which the cans are moved to effect the spraying of the surfaces of the cans as the cans move past the spraying means.

U.S. Pat. No. 3,704,685 (Neumann et al.) discloses apparatus for cleaning the surfaces of cans and comprises plural angularly oriented spray nozzles directed about the periphery of the cans. The cans are guided between peripherally spaced guide rods. The nozzles are oriented such that the liquid streams emanating therefrom impinge upon the can to promote the movement of the can along the guide rods and towards the outlet end of the washing section of the apparatus.

Accordingly, it is a general object of this invention to provide a container treating system which overcomes the disadvantages of the prior art.

It is a further object of this invention to provide a container treating system which is capable of efficient, yet high speed operation.

It is still a further object of this invention to provide a system for cleaning, rinsing, coating and drying the surfaces of cans at a high rate of speed and without the formation of residue spots thereon.

It is yet a further object of this invention to provide apparatus for either washing, rinsing, coating or drying the entire surface of a can at a high rate of speed and which apparatus may be used with other apparatus to form a can cleaning and treating system.

These and other objects of the invention are achieved by providing apparatus for treating the surface of a plurality of open cylindrical containers at a high rate of speed, with each of the containers having a side wall encircling a longitudinal axis of the container and an end wall at one end of the side wall. The apparatus comprises an enclosed housing and carrier means disposed within the housing for receipt of the containers to be treated. The carrier means is rotatable about a first axis for carrying the containers from an entrance location in the housing in a circular orbit about the first axis to an exit location in the housing. Means are provided to effect the rotation of the containers on their respective axis as they move along the orbit. First spraying means are provided and include plural heads for spraying a fluid therefrom. Each of the heads is arranged to reciprocate into and out of a respective one of the containers as the containers traverse the orbit to treat the interior surface of the side wall and the end wall of the container. Second spraying means are arranged to spray fluid radially outward from the center of the orbit to the exterior surface of the side wall of the container. Third spraying means are arranged to spray the fluid along a portion of the length of the orbit to effect the treating of the exterior surface of the end wall of said containers.

Other objects and many of the attendant advantages of this invention will be readily appreciated as the same becomes better understood by reference to the following detailed description when considered in connection with the accompanying drawings wherein:

FIG. 1 is a side elevational view of a portion of a can treating system in accordance with this invention;

FI. 2 is a top elevational view of the portion of the system shown in FIG. 1;

Figure 1:
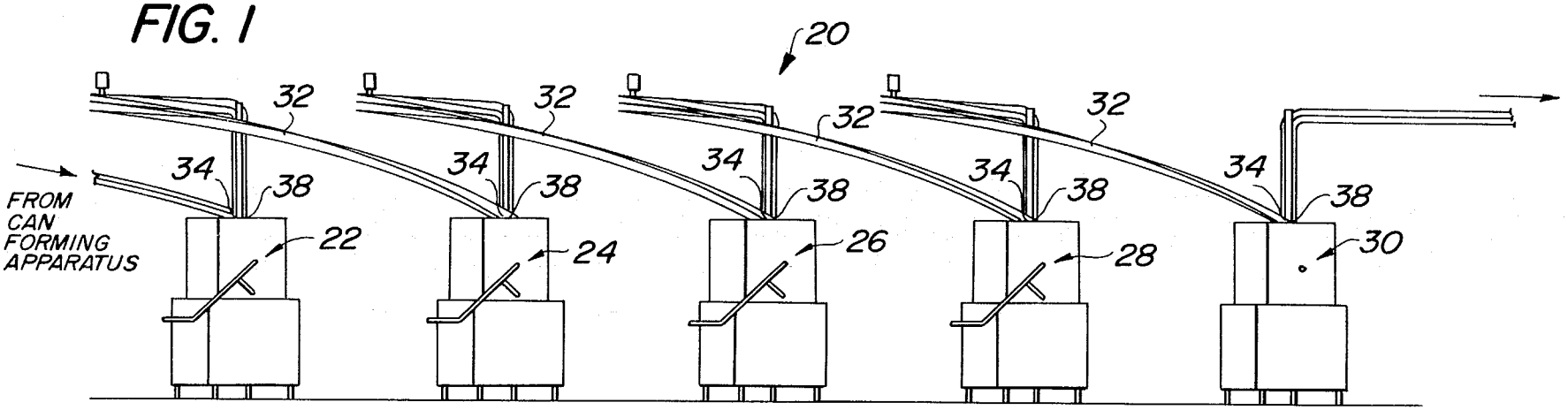
Figure 2:
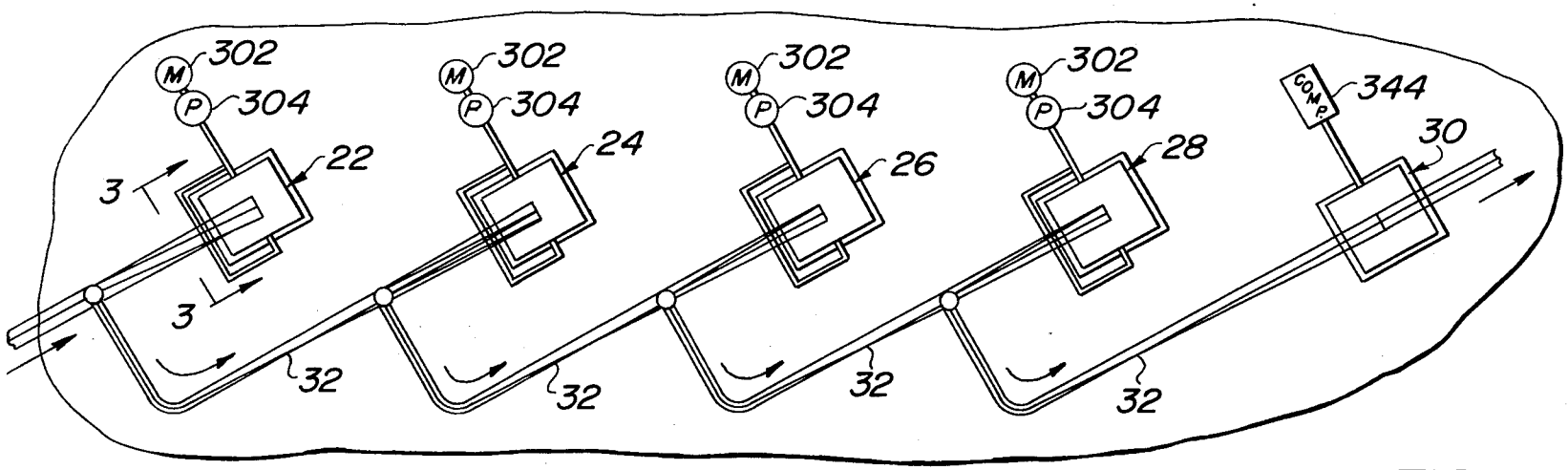
Figure 4:
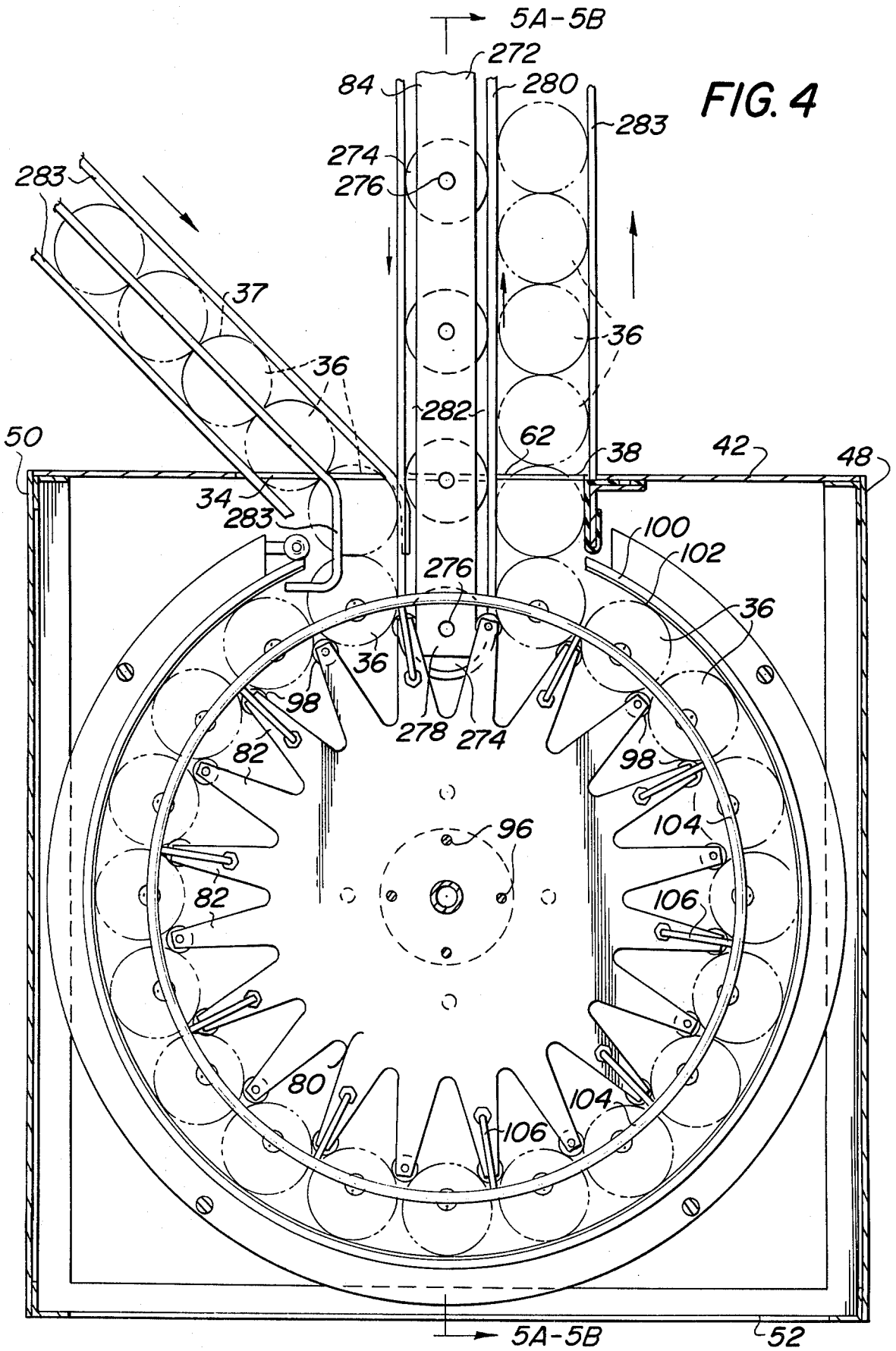
FIG. 4 is a sectional view taken along line 4—4 of FIG. 3.
Figure 5A:
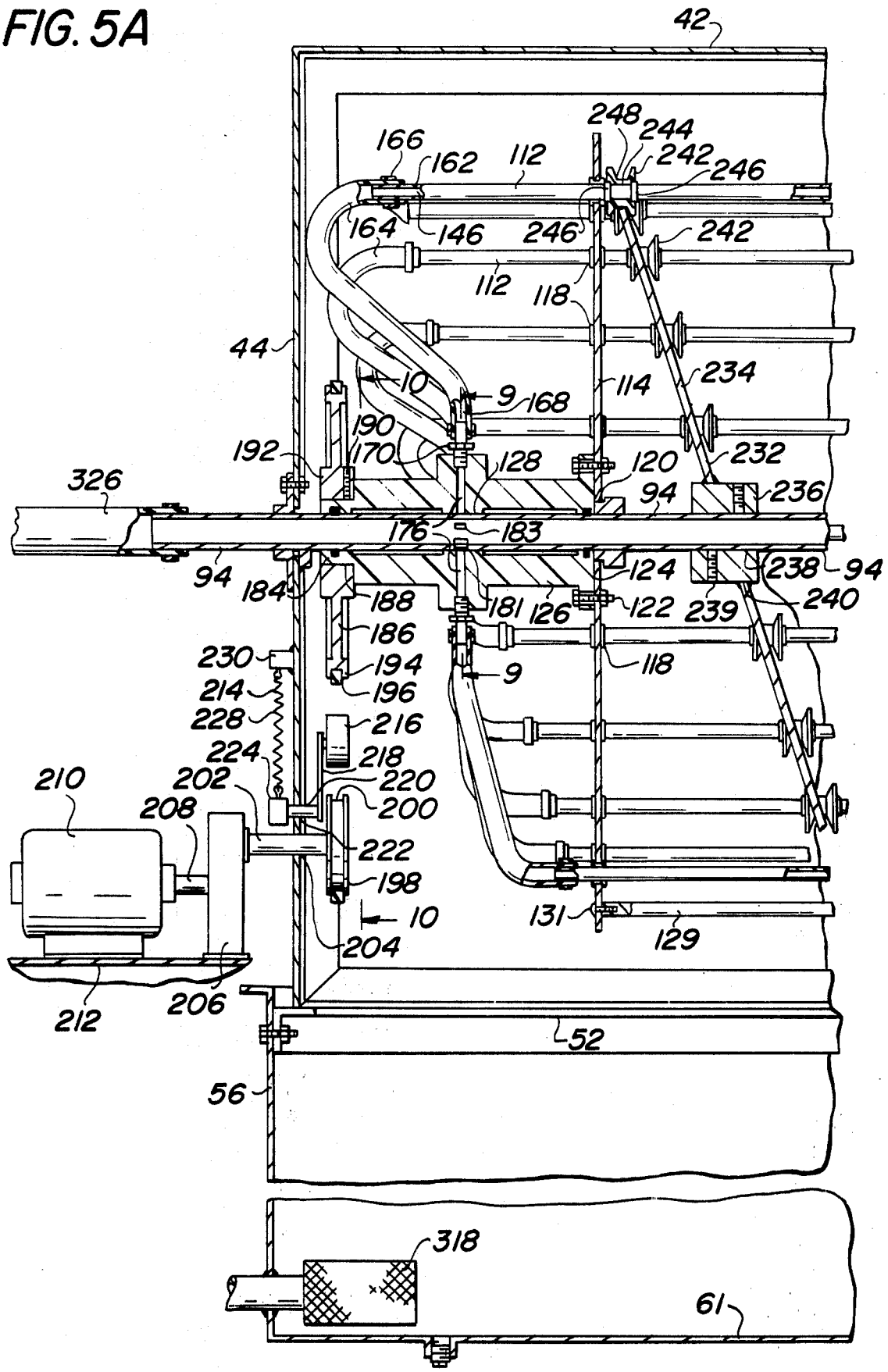
Figure 5B:
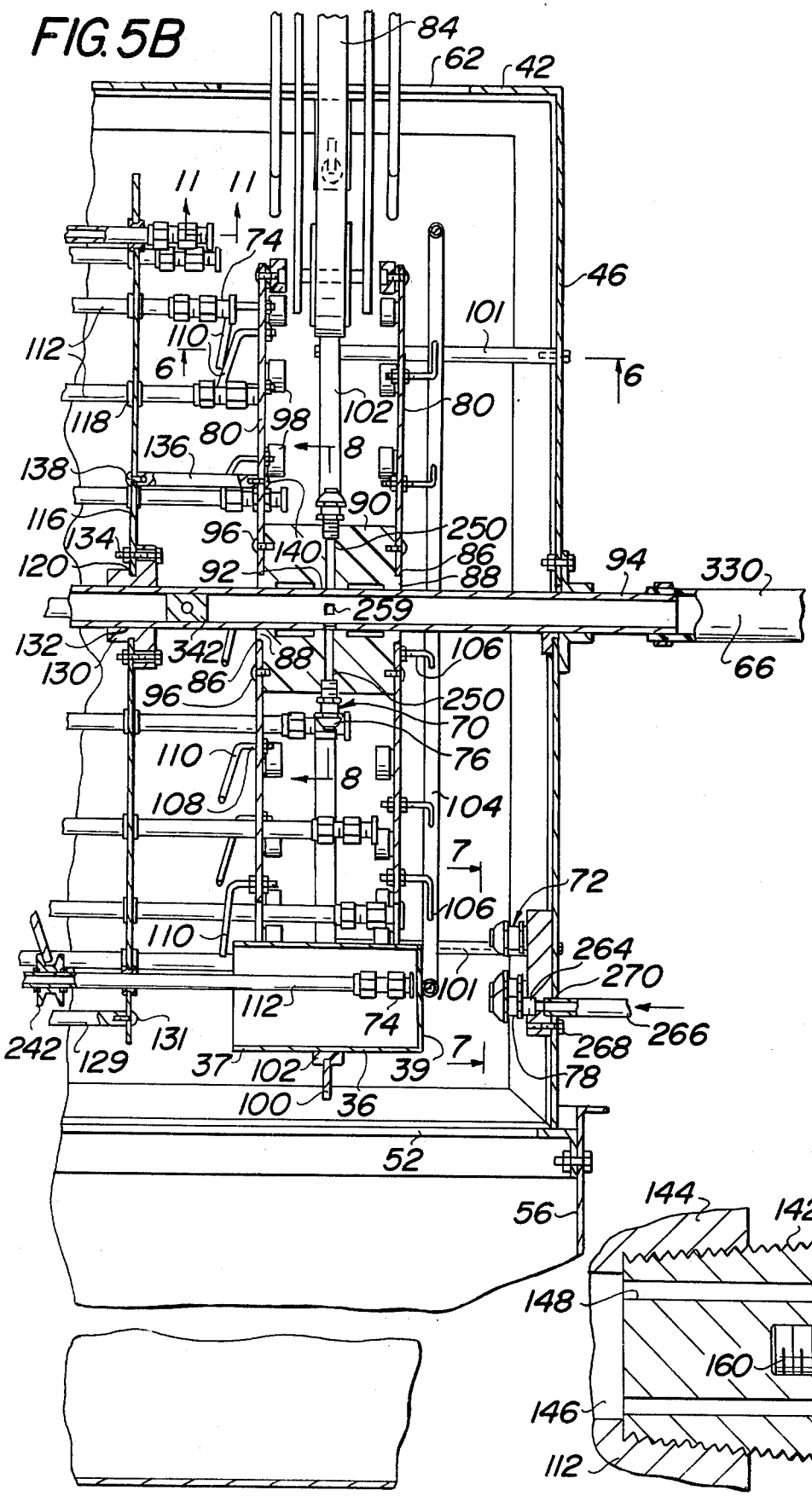
Figure 6:
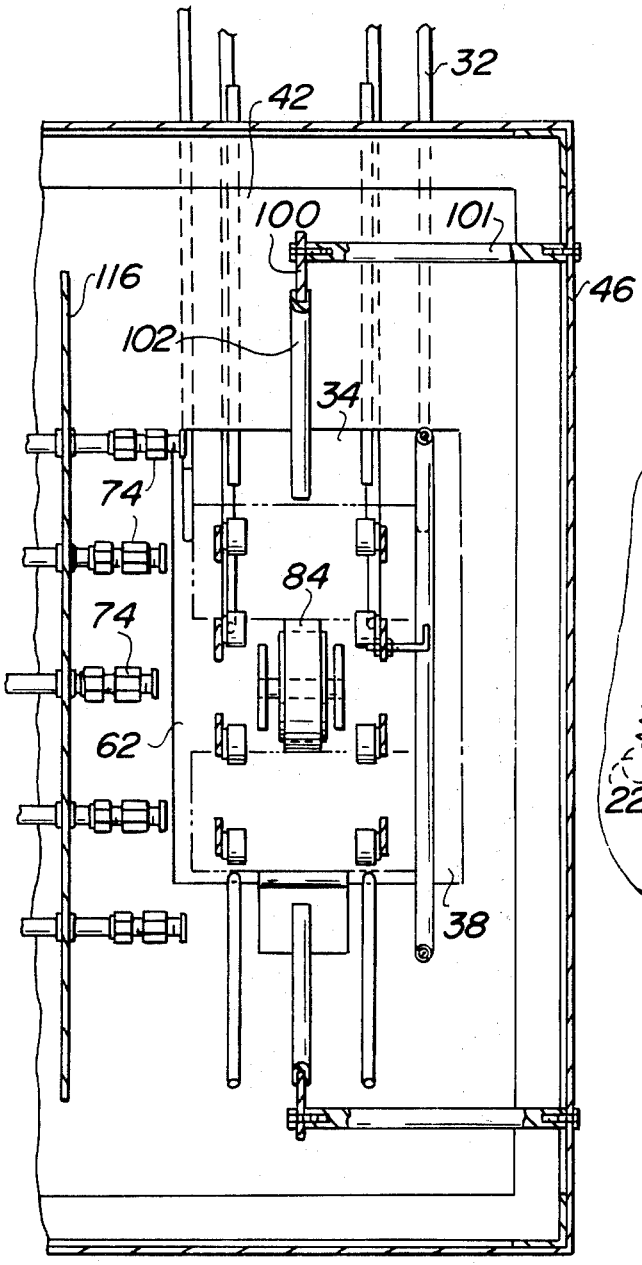
Figure 10:
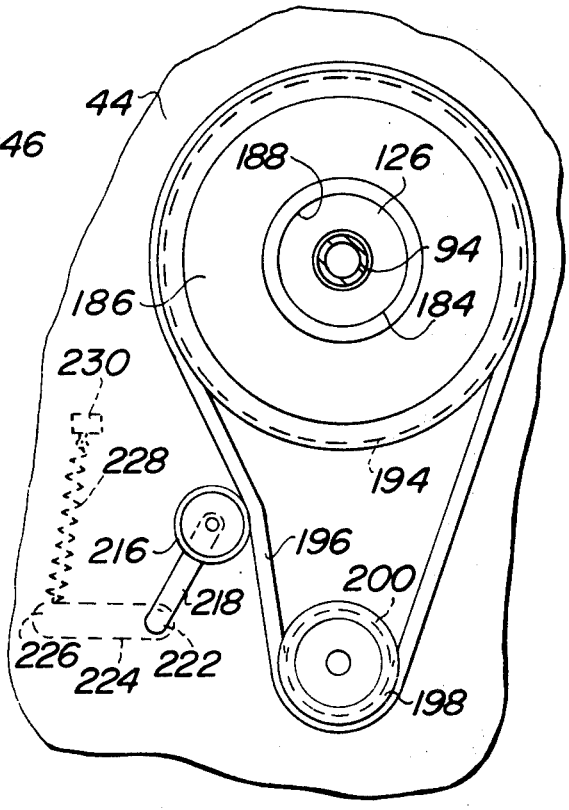
Figure 7:
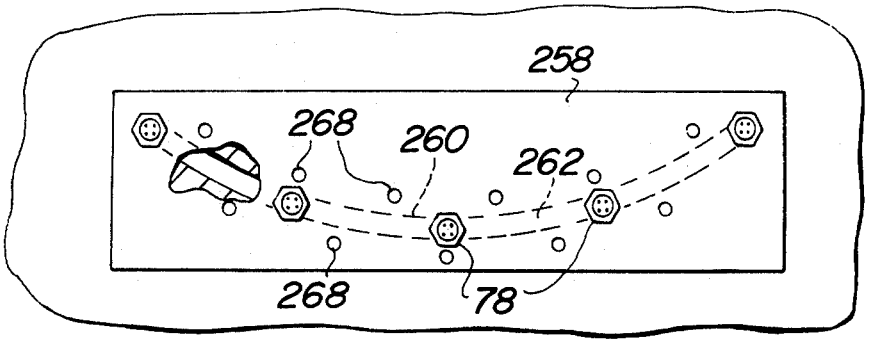

FIG. 5, comprising partial sectional views 5A and 5B, is a sectional view taken along line 5A5B—5A5B of FIG. 4;

FIG. 6 is a sectional view taken along line 6—6 of FIG. 5B;

FIG. 7 is a sectional view taken along line 7—7 of FIG. 5B;

FIG. 8 is a sectional view taken along line 8—8 of FIG. 5B;

FIG. 9 is a sectional view taken along line 9—9 of FIG. 5A;

FIG. 10 is a sectional view taken along line 10—10 of FIG. 5A;

FIG. 11 is an enlarged sectional view taken along line 11—11 of FIG. 5B;

FIG. 12 is a schematic diagram of the fluid conveying and pumping system of the units in the various stages of the system shown in FIG. 1; and FIG. 13 is a diagrammatic illustration showing the movement and orientation of the cans between the successive treating stages of the instant invention.

Referring now to the various figures of the drawing wherein like reference characters refer to like parts, there is shown in FIG. 1 a high speed system 20 for treating cans as they are produced by can forming apparatus (not shown) to prepare the surfaces of the cans for subsequent treating operations, e.g., lithography, painting, labelling, etc., by cleaning and rinsing the cans and thereafter applying one or a combination of various protective coatings and/or linings on the clean surfaces of the cans followed by drying the coated cans.

System 20 basically comprises plural units 22, 24, 26, 28 and 30 which are serially interconnected, via a conveyor system 32, and which form successive can-treating stages of the system. The first unit 22 forms the first stage of the system 20 and is adapted to clean or wash the entire surfaces of the newly formed cans. Each of the cans 36 produced by the forming apparatus if an identical construction and comprises a circular side wall 37 (FIG. 5B) and an integral closed end wall 39 (FIG. 5B). The end opposite end wall 39 is open to provide access to the interior of the can. Once the can is filled the open end is capped shut.

As can be seen in FIG. 1, unit 22 includes an inlet 34 connected to the output (not shown) of a can forming apparatus, such as a Drawing and Ironing machine(s), via a portion of the conveyor system 32. The conveyor system 32 will be described in more detail hereinafter, suffice for now to say that it is operative for serially transporting or carrying newly formed cans 36 at a high rate of speed between the different units of the system. To that end, conveyor 32 serves to serially transport the cans 36 from the output of the can forming apparatus to the inlet 34 of unit 22 (the first stage of the system). The cans are cleaned serially in unit 22 and, as will be described in detail later, exit the unit at an outlet 38.

The unit 24 forms the second stage of the system and is adapted to rinse the surfaces of the cans which have been cleaned in unit 22. To that end, unit 24 includes an inlet 34 connected, via a succeeding portion of conveyor system 32, to the outlet 38 of the unit 22. The rinsed cans exit unit 24 at its outlet 38.

The unit 26 forms the third stage of the system and is adapted to provide a further rinse to the surfaces of the cans exiting from unit 24. To that end, unit 26 includes an inlet 34 connected to the outlet 38 of the first rinsing stage 24, via a yet succeeding portion of the conveyor system 32. The finally rinsed cans 36 exit unit 26 at its outlet 38.

The unit 28 forms the fourth stage of the system and is adapted to apply a protective coating and/or lining to the surfaces of the finally rinsed cans. To that end, unit 28 includes an inlet 34 connected to the outlet 38 of the unit 26, via still a further succeeding portion of the conveyor system 32. Once coated in unit 28 the cans exit unit 28 at its outlet 38.

The unit 30 forms the fifth and last stage of the system and is adapted to dry the coated cans so that they may handled for subsequent treatment. To that end, unit 30 includes an inlet 34 connected to the outlet 38 of the unit 28, via the next succeeding portion of the conveyor 32. The cans dryed in unit 30 exit therefrom at its outlet 38. The outlet 38 is connected to the last portion of the conveyor system 32. which is operative for carrying the dryed cans to means (not shown) for subsequent treatment of the cans.

It should be noted at this juncture that while all of the units 22–30 are of the same general construction, nevertheless, slight structural differences, e.g., nozzle shapes, may exist among the units to enable each unit to accomplish its respective operation (e.g., cleaning, or rinsing, or coating, or drying). The differences between units, if any, are slight and are merely expedients. Therefore, such differences will not be described in detail herein, instead the description of unit 22 is meant to cover the description of the remaining units 24–30, unless stated to the contrary.

Figure 3:
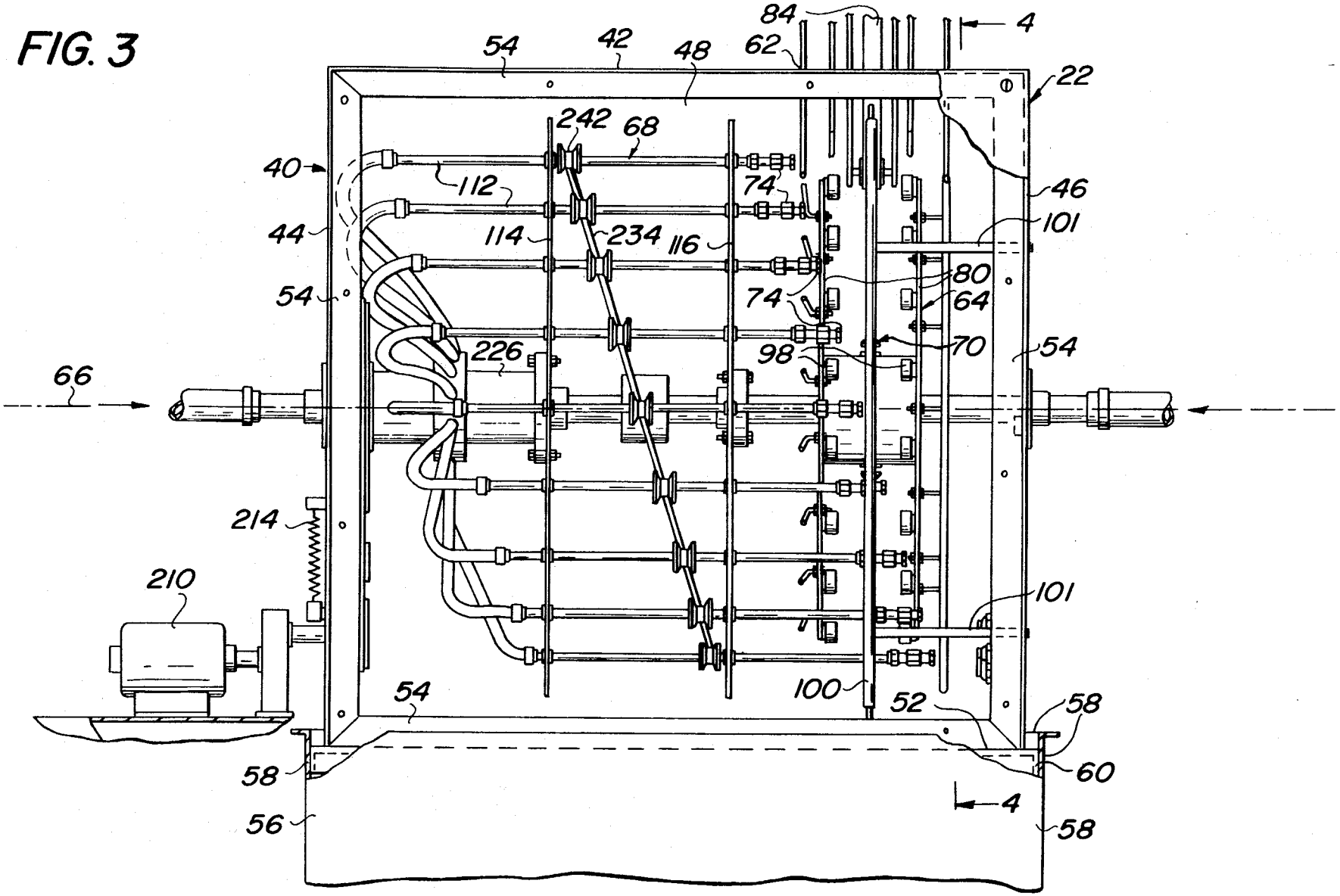
FIG. 3 is an enlarged sectional view taken along line 3—3 of FIG. 2.

As can be seen in FIGS. 1 and 3, the washing unit 22 comprises a housing 40 which is of a box-like construction having a top wall 42, a pair of opposed end walls 44 and 46, a pair of opposed side walls 48 and 50 and an open bottom 52. The walls of the housing are formed of sheet metal and are interconnected via flanges 54. Although not shown in the drawing, the housing is constructed in two separable portions or sections, an upper section and a lower section, with the upper section including the top wall 42 and the upper portions of the side walls and end walls and being removable from the bottom section to provide ready access to the interior of the housing. This feature is of considerable importance in that it permits the removal of a defective component(s) from the unit and its replacement by an operative component(s) with a minimum of "downtime", that is time that the system 20 would be inoperative in the event of a breakdown of a component.

As will be described in detail later, a reservoir or tank 56 is mounted under the housing 40 for collecting residual liquid used in the treatment of the cans 36 to permit the reuse of such liquids as desired. The tank 56 is of a box-like construction having plural side and end walls 58 and a closed bottom wall 61 (FIG. 5A). A mounting flange 60 is secured along the uppermost edge of each of the side walls and end walls of the tank 56 on the inside surface thereof and serves as a support for housing 40. Accordingly, liquid used by the components within housing 40 is enabled to drop through the open bottom 52 of the housing for collection in the tank 56.

The top wall 42 of the housing 40 includes an opening 62. As can be seen most clearly in FIG. 13, the opening 62 forms the inlet 34 and outlet 38 of the housing, with one side of the opening 62 forming the inlet 34 and the other side of the opening forming the outlet 38.

The means for effecting the treating of the cans brought into the unit 22 basically comprises a carrier 64 and plural spray heads associated therewith. The carrier, as will be described in detail hereinafter, is a rotatable member adapted for rotating about a main axis, identified by the reference numeral 66, to serially pick up cans 36 provided at the inlet 34 and to carry each can at an attitude wherein the can's longitudinal axis if maintained parallel to the main axis 66 through a circular orbit about the axis 66 and to the outlet 38, from whence the cans are removed from unit 22. The carrier 64 coacts with means, to be described in detail later, to cause each of the cans to rotate in planetary motion through its circular orbit about main axis 66, that is each of the cans is made to rotate about its respective longitudinal axis as the cans traverse the circular orbit about axis 66 from the inlet 34 to the outlet 38 of the unit 22.

In accordance with the preferred embodiment of this invention, the means for effecting the treating of the surfaces of the cans in unit 22 comprises three spraying means 68, 70 (FIGS. 3 and 5B) and 72 (FIG. 5B). The first of the aforenoted spraying means includes plural spray heads 74 disposed at equal spacing about axis 66 and adapted to rotate about that axis while reciprocating in a direction parallel to that axis. This action permits each spray head 74 to enter into the open end of a respective can 36 at an initial point in the orbit of the can so as to effect the spraying of the interior surfaces of the can. The spray head 74 continues moving into the can during the continued planetary motion of the can about axis 66, and then reverses direction to begin retraction from within can's interior. The spray head 74 is retracted completely from within the can adjacent the end of the orbit, that is adjacent to outlet 38 of unit 22, to permit the can to be readily extracted from the unit. By the time that the can has reached the end portion of its circular orbit about axis 66, its interior surfaces will have been completely contacted by the fluid emitted by the reciprocating spray head 74.

The second of the aforementioned spraying means, namely, 70, comprises plural spray heads 76 (FIG. 5B) extending radially outward from axis 66 and towards carrier 64. The spraying means 70 is adapted to spray fluid at the outer surfaces of the circular side walls of the cans as the cans are carried by the carrier in planetary motion about axis 66. The details of the spraying means 70 will be described in detail later.

The last mentioned of the spraying means, namely, means 72, comprises plural spray heads 78 mounted along a portion of the orbital path through which the carrier carries the cans between the inlet 34 and the outlet 38. The spray heads 78 are directed at the outside surfaces of the closed ends of the cans 36 as they are supported in the carrier through the circular orbital path to effect the spraying of those surfaces. The details of the spraying heads 78 will be described in detail later.

The spraying means 68, 70 and 72 operate continuously as the cans are carried serially through the unit 22 to effect the spraying of all the interior and exterior surfaces of each can before it leaves the unit.

The coation of the planetary motion imparted to the cans and the fluid being sprayed from the spraying means at the cans during such motion is extremely effective in cleaning and drying the cans since the centripetal force of the rotating cans causes the treating liquids to be thrown off the cans, whereupon the cans dry evenly and quickly and without and residue spots.

Reference will now be made to FIGS. 3, 4 and 5B for the details of the carrier 64. As can be seen therein, the carrier comprises a pair of planar disc-shaped members parallely spaced from one another. Each member 80 includes plural tapered projecting arms 82 extending radially from the center of the disc-shaped member so as to give the member 80 a generally star-like overall shape. The two plates 80 are mounted with their arms 82 aligned longitudinally (in the direction parallel to axis 66) and are adapted to be rotated as a unit about axis 66. To that end, each plate includes a central opening 86 in which an annular flange 88 of a central mounting hub 90 is disposed. The central mounting hub is formed of a plastic material, such as nylon, in the interests of low friction, and includes a central opening 92 extending therethrough. A stationary central supply tube 94, concentric with axis 66 and whose construction and operation will be described in detail later, extends through opening 92 in hub 90, with the hub being freely rotatable thereabout. Plural threaded fasteners, such as screws 96, are provided to secure the discs 80 to the hub 90. Accordingly, the hub 90 and the discs 80 connected thereto are enabled to rotate as a unit about tube 94 and hence axis 66.

As can be seen clearly in FIGS. 4 and 5B, each of the arms 82 of the carrier includes a roller 98 mounted thereon with the axis of rotation of the roller extending parallel to axis 66. The space between immediately adjacent rollers on each disc serves as a pocket or recess for receiving a portion of the periphery of a can 36, with the recess formed between the immediately adjacent rollers of one disc serving to hold the open end portion or the can while the corresponding recess formed by the rollers 98 of the other disc serve to hold the closed end of the can.

As can be seen in FIG. 4, a circular ring 100 is disposed about the periphery of the carrier 64 and lies in a plane intermediate the discs 80 forming said carrier. The ring 100 is mounted on the side wall 46 of said housing via plural elongated standoffs 101 (FIG. 3). The ring 100 forms a stationary raceway operative, in coation with the rotating carrier, to effect the rotation of each of the cans about its respective axis so as to impart planetary motion thereto. To that end, the circular ring 100 includes a rubber inner peripheral raceway surface 102. The raidus of curvature of the rubber raceway 102 is of a predetermined dimension such that when cans 36 are received in the recesses between rollers 98 of the carrier the cans are squeezed between those rollers 98 of the carrier and the rubber raceway surface 102 of the ring 100. This action, while deflecting the cans slightly, ensures that the circular side wall of the can makes good contact with the rubber surface 102, which contact is of considerably importance in order to impart planetary motion to the cans 36 (as will be described later ).

As can be seen in FIG. 4, means 84, to be described in detail later, are provided within opening 62 in the top wall 42 of the housing and between the inlet 34 and the outlet 38. The means 84 is operative for serially pulling the cans 36 into the recesses between the rollers 98 of the carrier as the carrier rotates about axis 66, to positively seat each can in its respective recess. The means 84 is also operative to effect the positive extraction of each can from its respective recess at the end of the can's traversal of the circular orbit about axis 66.

Operation of the carrier 62 is as follows: The conveyor 32 carries a can to inlet 34, whereupon means 84, in a manner to be described later, pulls the can into positive seating between the immediately adjacent rollers forming one can receiving recess in the carrier. The carrier 64 in the meantime is rotating about axis 66, whereupon the can is carried by the recess in the carrier into contact with the upstream end of the rubber raceway 102 of circular ring 100. This action causes the very slight deflection of the circular side wall of the can to squeeze the can between the rubber raceway and the rollers 98, thereby creating good frictional engagement between the periphery of the can and the rubber raceway. The continued rotation of the carrier 64 causes the can carried thereby to roll along the rubber raceway 102 to effect the rotation of the can about its longitudinal axis. The can continues rotating all during its traversal of the circular orbit about axis 66 until the can reaches the downstream end of the circular raceway 102. At this point the can is acted upon by means 84, in a manner to be described later, to positively extract the can from the recess and pull it through outlet 38 and into the conveyor system 32 for carriage to the next stage of the system 20.

In order to ensure that the cans do not move or slip toward side wall 48 and out of the recess in which they are seated during the rotation of the carrier, a circular stop rail 104 is mounted on the disc 80 closest to the side wall 46. The diameter of the stop rail is such that it is disposed immediately adjacent to the closed end of the carried cans and between the raceway 102 and the rollers 98. The stop rail 104 is mounted on the disc 80, via plural standoffs 106. Plural stops 108 are mounted on the other disc 80 and include extending portions 110 which extend between the tapered arms 82 of the disc 80. The stops 108 serve a similar function to stop rail 104, that is to prevent the cans 36 disposed within the recess in the carrier from moving or slipping towards side wall 44 and out of their respective recesses.

The details of the reciprocating spray means 68 will be described in detail hereinafter with reference to FIGS. 3, 5A and 5B. As can be seen therein, the spraying means 68 includes plural reciprocable conduits 112. Each conduit is an elongated rigid tube having at its free end a respective spray head 74. The details of spray head 74 will be described in detail later with reference to FIG. 11.

Each of the conduits 112 is disposed with its longitudinal axis parallel to the main axis 66 and spaced a predetermined radial distance from said axis. The radial distance that the conduits 112 are spaced from axis 66 corresponds to the radial distance between said axis and the longitudinal or central axis of the cans 36 when the cans are disposed within the carrier and in motion through their orbital path. The conduits 112 are mounted in position by a pair of circular mounting plates 114 and 116. Each mounting plate includes a plurality of openings disposed at equally spaced locations along a circular path whose radius is the predetermined radius between the central axis 66 and the conduits 112, so that each conduit extends through a respective opening in one plate and a corresponding respective opening in the other plate. As noted heretofore, the conduits are adapted to be reciprocated in directions parallel to the axis 66. To that end, each of the openings in the mounting plates 114 and 116 is provided with a nylon sleeve 118 having a central opening therein and through which the conduit extends. The sleeves 118 enable the conduits to be reciprocated through the opening with very little friction.

The plates 114, in addition to holding the conduits in place, also serve to effect the rotation of the conduits about central axis 66 as a unit and in unison with the rotation of carrier 64 thereabout. To that end, the circular mounting plate 114 includes a central opening therein, through which the fixed central supply tube 94 extends. The plate 114 lies in a plane perpendicular to axis 66 and is fixedly secured, via plural threaded fastening means 122, to the end wall 124 of a rotatable manifold or hub 126. The hub 126 includes a central opening 128 through which the stationary central supply tube 94 extends. In accordance with the preferred embodiment of the invention hub 126 is formed of a plastic material, such as nylon, so as to permit it to freely rotate about the tube 94.

The circular mounting plate 116 is mounted on the central supply tube 94 at a spaced location from mounting plate 116 in an analogous manner to the mounting of plate 114. To that end, plate 116 includes a central opening 120 through which a rotatable hub 130 extends. The hub 130 includes a central opening 132 through which the stationary supply tube 94 extends. The plate 116 is secured to the hub 130 via plural threaded fasteners 134. In accordance with the preferred embodiment of the invention hub 130 is also formed of a plastic material, such as nylon, so as to permit it to freely rotate about tube 94.

In order to secure plate 114 to plate 116 and to hold said plates at the desired spacing while enabling the plates to rotate in unison about axis 66. Plural connecting rods 129 are provided. The rods are elongated members which extend parallel to axis 66 and are connected at their respective ends to plates 114 and 116, via screws 131.

As can be seen in FIG. 5B, the mounting plate 116 is fixedly connected to the immediately adjacent star-like disc 80 of the carrier 64, via plural connecting rods 136 (only one of which can be seen). One end of each connecting rod is secured via a screw 138, to plate 116 and the other end of the rod 136 is connected to plate 80, via screw 140. The connecting rods 136 serve to couple the rotation of plates 114 and 116 to the carrier 64 so that the carrier and the spraying means 68 supported by the plates rotate in unison about axis 66.

Each of the spray heads 74 is of identical construction and is adapted to spray a fluid, in the case of washing unit 22 a cleaning liquid, in the case of units 24 and 26 a rinsing liquid, such as water, in the case of unit 28 a coating liquid and in the case of drier unit 30, air, therefrom. To that end, each nozzle includes a threaded coupling 142 threadedly secured in the open free end 144 of an associated conduit 112. Each conduit includes a central passageway 146 through which the liquid to be sprayed by the head 74 passes. The connector 142 includes an annular passageway 148 extending the full length thereof. The tip of spray head 74 is in the form of an enlarged nozle head 150 having plural orifices 152 equally spaced in a circular pattern on the face 154 of the head 150. Each of the nozzles is connected, via an associated passage 156, to an annular mixing chamber 158 within nozzle head 150. The nozzle head 150 is secured to coupling 142, via a fastening bolt 160, with the annular mixing chamber 158 in fluid communication with the annular passageway 148. Accordingly, liquid passing through the passageway 146 in the conduit 112 is able to enter through annular passage 148 and into the mixing chamber 158 and from there through communicating passageway 156 to orifice 152 for ejection into the air.

The means for providing liquid to the interior passageway 146 of each of the conduits 112 will now be described. As can be seen in FIG. 5A, the free end 162 of each of the conduits 112 is connected to a flexible hose 164, via a coupling 166. Each hose 164 includes a central passageway 168. The other end of each hose is connected, via a respective fluid coupling 170, to hub 126 which acts as a manifold.

As can be seen in FIG. 9, the couplings 170 extend radially from the hub and each includes a portion 172 which extends into the passageway 168 of the hose and a threaded portion extending in the opposite direction as portion 162. The threaded portion of each coupling is threadedly enagaged in a respective mating opening in the hub 126. A central passageway (not shown) extends through each coupling and communicates with a respective radially extending passageway 176 in the hub 126. The central portion of the hub includes an enlarged opening 178 which is in fluid communication with each of the radially extending passages 176.

As can be seen in FIG. 9, a peripheral portion of the side wall of tube 94 disposed within hub 126 and denoted by the reference numeral 180 lies between a pair of openings 181 communicating with the interior of tube 94. The remaining peripheral portion of tube 94 between the openings 181 is of reduced thickness to form a recess 183. Other openings 187 are provided into recess 183. The openings 181 and 185 enable fluid to pass from the interior of the tube 94 into the recess 183 and from there into the communicating radially extending passageway 176. The portion 180 extends for approximately 30 degrees and serves as a port closing means to block a few of the radial passages 176 and thereby isolate those passages from the recess 181. As can be seen, only the most upward extending passages are blocked (passages within a thirty degree range centered about the vertical direction). The purpose of such isolation is to ensure that no liquid is enabled to flow through the blocked passages and the associated conduit 112 and spray heads 74 for reasons to be described in detail later. Insofar as the unblocked passages 176 are concerned, it should be appreciated that liquid provided into recess 183 is enabled to flow through the communicating radially extending passages 176, the associated connectors 170, the associated flexible hoses 164 and the associated conduits 112 to the associated spray heads 74.

The means for providing the fluid to be sprayed by means 68 will be described later.

The means for effecting the simultaneous rotation of the carrier 64 and the reciprocating spray means 68 is best seen in FIGS. 3, 5A and 5B. As can be seen therein, the hub or manifold 126 includes a circular ledge 184 of reduced diameter at the end thereof closest to side wall 44 of the housing 40. A pulley 186 having a circular central opening 188 is mounted on the circular ledge 184 and is secured in place, via the use of a set screw 190 extending radially through the hub portion 192 of the pulley and into contact with the ledge 184. The periphery of pulley 186 includes a recess 194 thereabout. A drive belt is seated within the recess. The drive belt is operative, when circulated as will be described hereinafter, to rotate the pulley and thereby rotate the manifold or hub 126. To that end, the drive belt 196 extends around a drive pulley 198 and is seated within groove 200 in the periphery thereof. The drive pulley 198 is mounted on the free end of a rotary shaft 202. The shaft 202 extends through an opening 204 in the side wall 44 of the housing 40 and into the interior of a gear box 206. The shaft 202 forms the output of the gear box 206. The input of the gear box 206 is provided, via a rotary drive shaft 208 of an electrical motor 210. The motor 210 is mounted on a support 212 disposed adjacent to the housing 40.

In order to maintain the proper degree of tension of the drive belt 196 to ensure that no slippage on the pulleys 186 and 198 occurs, a spring biased idler assembly 214 is provided. As can be seen, assembly 214 comprises an idler roller 216 mounted on the free end of a pivoting arm 218. The other end of the arm 218 is fixedly secured to a rotatable shaft 220 which extends through an opening 222 in the side wall 44 of the housing. The other end of shaft 220 is fixedly secured to one end of a pivoting arm 224 (see FIG. 11). The other end of arm 224 is connected, via a coiled tension spring 228, to a mounting block 230 fixedly secured to the side wall 44 of the housing 40. It should thus be appreciated that the tension in spring 228 causes arm 224 to pivot upward (in the clockwise direction as viewed in FIG. 11) to cause the concomitant pivoting of arm 218 and idler 216 mounted thereon, whereupon the idler roller 216 applies an inward force on the drive belt 196 to provide the desired tension thereon. Accordingly, the rotation of pulley 198, via shafts 204, 208 and gear box 206 from motor 210, is coupled through the drive belt 196 to the pulley 186 and from there to the hub 126.

Since, as noted heretofore, the circular mounting plate 114 is secured to hub 126, via bolts 122, and since mounting plate 116 is connected to mounting plate 114, via the connecting bars 129 and associated screws 131, the rotation of hub 126 about the supply tube 94 by motor 210 is coupled to the mounting plates 114 and 116, whereupon the conduits 112 mounted within the sleeves 118 in the mounting plates are rotated about the central axis 66 as the hub us rotated. In addition, the carrier 64, as noted heretofore, is connected to the mounting plate 116 via connector bars 136 and associated bolts 140, whereupon the carrier is also rotated on its hub 90 by the rotary force imparted to hub 126.

It should thus be appreciated that the rotation of hub 126 by the motor and connected pulley system effects the concomitant rotation of the spraying heads and carrier about the central axis 66.

As noted heretofore, the spray heads 74 are adapted for reciprocation into and out of the cans as the cans are supported by the carrier and move through the orbital path from the inlet to the outlet of the housing. To effect such reciprocation, camming means, 232 (FIG. 5A), is provided. The camming means basically comprises a planar member or plate 234 mounted on the supply tube 94 at a skewed angle to the central axis 66, with the upper portion of the plate disposed closest to the top wall 42 and side wall 44 of the housing and with the bottom portion of the plate being disposed closest to the bottom 52 and side wall 46 of the housing. The mounting of the plate 234, hereinafter called a wobble plate, is effected via a mounting ring 236. The mounting ring 236 is an annular shaped member having a central opening 238 through which the fixed supply tube 94 extends. Plural set screws 239 extend radially inward through the ring 236 and into contact with the tube 94 to fixedly secure the ring 236 in place with respect to the tube 94. The wobble plate 234 includes a cental opening 240 therein and through which the ring 236 extends. The wobble plate is fixedly secured to the ring 236, as by welding, about the periphery of opening 240. The outer periphery of the wobble plate forms a circular path when viewed down axis 66, with the radius of the path being approximately the same as the radius at which the conduits 112 are disposed about the central axis 66. The periphery of the wobble plate 234, provides a camming surface about which plural rollers 242 roll. Each roller is mounted on a respective conduit 112 in a manner to permit it to rotate about the axis of the conduit but not to move laterally along said conduit.

The mounting of rollers 242 on the conduits 112 is clearly shown in FIG. 5A. As can be seen therein, each roller 242 includes a central opening 244 through which an associated conduit 112 extends. A pair of retaining rings 246 are received within respective recesses in the sides of roller 242 and are secured to the periphery of the conduit 112 so as to fix the longitudinal location of the roller with respect to the conduit and to preclude any displacement of the roller therealong.

In accordance with the preferred embodiment of the invention, the rollers 242 are formed of a plastic material, such as nylon, to enable them to rotate freely about conduit 112. Each of the rollers 242 includes an outer peripheral recess 248 adapted to receive the peripheral edge of the wobble plate 234, such that the rollers 242 can roll therealong. Since the wobble plate is mounted at a skewed angle with respect to the central axis 66, with the upper portion of the wobble plate disposed closest to the side wall 44 and with the bottom portion of the wobble plate being closest to the side wall 46, as the rollers roll down the wobble plate from the top portion to the bottom portion they translate in a direction parallel to axis 66 and towards the carrier 64, while the rollers rolling up the wobble plate translate in the opposite direction, e.g., away from the carrier. By virture of the fact that the rollers 242 are fixed longitudinally on the conduits 112, the longitudinal movement of the rollers effects the same movement of the conduits.

In accordance with the preferred embodiment of the invention, the skewed angle at which the wobble plate is mounted is selected so as to provide a sufficient excursion of the conduits 112 during each reciprocation cycle to enable the spray heads 74 mounted thereon to enter into the open end of each of the cans, extend for approximately the full distance into the can then retract fully out of the can and a sufficient distance away from the open mouth thereof so as not to impede the extraction of the cans from the housing. In FIG. 5B there is shown the various locations of the spray heads 74 starting at the most retracted position (the uppermost spray head) and ending with the most extended head 74 (the lowermost head).

Attention is now directed at FIGS. 5B and 8 wherein the details of the second spraying means 70 are shown. The spraying means 70 rotates in unison with the carrier and is operative to spray fluid radially outward from the central axis 66 and at the outside surfaces of the side walls of the cans 36 as the cans are carried their planetary motion throughout the orbit by carrier 64. To that end, as can be seen in FIGS. 5B and 8, the central hub 90 of the carrier 64 includes a plurality of radially extending passageways 250 therein. The passageways commence at a central opening 90 in the hub and terminate in respective enlarged threaded openings 252 about the periphery of the hub. The threaded openings 252 are each adapted to receive the threaded end 254 of a respective spray head 76.

As can be seen in FIG. 8, a peripheral portion of the side wall of tube 94, disposed within hub 90 and denoted by the reference numeral 256, lies between a pair of openings 257 communicating with the interior of the tube 94. The remaining peripheral portion of tube 94 between the openings 257 is of reduced thickness to form a recess 259. Another opening 261 is provided into recess 259. The openings 257 and 261 enable fluid to pass from the interior of the tube 94 into the recess 259 and from there into the communicating radially extending passageways 250. The portion 256 extends for approximately 180 degrees and serves as a port closing means for the upwardly extending passages to isolate the passageways extending upward at any instant in time from the recess 259. Accordingly, only the passageways 250 which are then extending downwardly or sidewardly are in communication with recess 259 and are hence permitted to carry the spraying fluid to the spray heads 76.

The means for providing the fluids to be sprayed by means 70 will be described later.

Reference should now be made to FIGS. 5B and 7 for a description of the details of the third spraying means 72. As noted heretofore, the third spraying means is operative to provide a fluid spray along at least a portion of the orbit through which the cans are carried by the carrier 64, to effect the treatment of the outside surface of the closed ends of the cans. To that end, as can be seen in FIGS. 5B and 7, plural spray heads 78 are mounted on a mounting block manifold 258 in an arcuate path 260. The radius of curvature of path 260 is approximately the same as the radius at which the spray heads 74 are mounted about the central axis 66. Accordingly, the spray heads 78 lie opposed to the spray heads 74 and hence a portion of the orbital path through which the cans are carried by the carrier 64.

In accordance with the preferred embodiment of this invention and for reasons to be described in detail later, the spray heads 78 extend only for the lowermost portion of the orbital path of the cans.

The manifold 258 includes a common passageway 262 in fluid communication with each of the spray heads 78. To that end, plural threaded openings 264 are provided at equally spaced locations along the manifold and in fluid communication with passageway 262 therein for mounting respective ones of the spray heads 78. Fluid is supplied to the common passageway 262 via a common conduit 266. The manifold 258 is mounted on the inside surface of the side wall 46 of the housing by screws 268, with a common conduit 266 extending through an opening 270 in the side wall for connection to means (to be described later) for providing fluid under pressure thereto.

Referring now to FIGS. 4 and 6, the details of the means 84 for ensuring the proper seating of the cans 36 within their respective recesses in the carrier and their proper extraction therefrom will be considered in detail. As can be seen therein, means 84 is mounted so that it extends through the opening 62 in the top wall 42 of the housing and between portions 34 and 38 of the opening, which portions define the inlet and outlet, respectively, of the unit. The means 84 comprises a pair of parallel standards 272 lying in respective planes between the planes of the star-like panels 80 of the carrier 64. A plurality of rollers 274 are mounted on respective shafts 276 extending between the standards 272. The lowermost ends of the standards, designated by the reference numeral 278 extend into the carrier and between the rollers 98 forming the can receiving recesses. A roller 274 is mounted on its associated shaft 276 between the standards at portion 278 so as to be substantially within the carrier 64. As can be seen in FIG. 5B, the spacing between the standards 272 is smaller than the spacing between corresponding rollers mounted on the two plates 80 so as not to impede the rotation of the carrier. A common belt 280 extends about the rollers 274 and is rotated at a predetermined high rate speed by means (not shown) in the direction of the arrows 282.

As can be seen, the portion of the belt 280 moving in the downward direction, as shown by the downward extending arrow 282 in FIG. 4, is disposed immediately adjacent to the inlet portion 34 through which cans are supplied by the conveyor system 32 and also immediately adjacent to the location on the carrier from which the cans begin their traversal of the orbital path between the inlet and the outlet. Therefore the circular side wall of each can which is brought into the inlet by the conveyor system makes contact with the outside surface of the circulating belt. The speed of circulation of the belt 280 is greater than the speed at which the cans are carried along their orbital path by the carrier and also faster than the speed at which the conveyor system supplies cans to the inlet. This action causes the cans which are brought into the inlet and into contact with the circulating belt to be positively pulled downward by their frictional engagement with the faster moving belt and into proper seating in the recesses of the carrier.

The upwardly extending portion of the circulating belt, identified by the upwardly extending arrow 282, is disposed immediately adjacent to the point on the carrier at which the cans complete their orbit such that when each can completes its orbit its circular side wall makes contact with the upwardly extending portion of the belt. Since the speed of circulation of the belt 280 is greater than the speed at which the cans are carried along the path by the carrier, the cans are positively pulled out of their seating in the recess of the carrier by their frictional engagement with the faster moving belt. Accordingly, it should thus be appreciated that the means 84 is effective for positively seating the cans within the carrier at the beginning portion of their traversal of the orbit and for effectively extracting the cans at the end of the orbit and after their treatment within the housing for supply to the conveyor system and the next stage of the system 20.

In order to insure that the cans are guided properly for insertion into the housing by means 84 and extraction from the housing by means 84, as described heretofor, guide rods 283 are provided. The guide rods from a portion of the conveyor means 32 and are directed vertically downward at the portions thereof extending into the housing 40.

As will be remembered, each of the spraying means 68 and 70 includes means for precluding certain spray heads from spraying when said heads are passed through particular portions of the orbit. For example, with regard to spray means 68, the spray heads 74 associated therewith are precluded from spraying by the action of port isolating means 180 when the spray heads are within a 30° range in the uppermost portion of the rotary path of the carrier. Similarly, the port isolating means 256 precludes the spray heads 76 of spraying means 70 from spraying liquid therefrom when said heads are in any orientation angled upward. The reason for such features is to preclude the associated means from spraying of liquid upwardly at the cans, since such upward spray could impede the proper seating of the cans as they are fed into the carrier by means 84 (the cans may be bounced around by the upwardly directed spray).

In addition, by precluding any upwardly directed spraying from occurring, no spray is permitted to exit through opening 62 in the top wall of the housing 40.

Fluid to be sprayed by the spraying means 68 and 70 is provided down the central opening in the main supply tube 94 and out through the radially extending openings 257, 261 and 181, 185, respectively. The means for providing liquid to be sprayed to the supply tube 94 as well as to the conduit 266 for spraying by the spray heads of spray means 72 comprises a fluid supply and recovery system 300 (FIG. 13). It should be noted that while the fluid system 300 shown in FIG. 13 is particularly adapted for use with units 22–28 (the units spraying liquids) the system 300 can obviously be modified such as by the addition of a compressor 344 and associated components, to provide a drying gas, such as air, under pressure to the spraying means 68–72 of the drying unit 30. As can be seen therein, fluid system 300 comprises a motor 302, a pump 304, a filter 306, a valve 308, a pressure gauge 310, another valve 312, another pressure gauge 314, a dump valve 316, a sump screen 318 and various conduits and hoses, to be described hereinafter, for connecting the aforenoted components. To that end, the outlet of the pump 304 is connected, via a pipe 320, to one side of the fluid filter 306. The outlet of the fluid filter 306 is provided into a conduit 322 having three branches, 324, 326 and 328. Branch conduit 326 is in the form of a flexible hose, such as rubber hose, and is connected, as can be seen in FIG. 5A, to one end of the central supply tube 84 which extends out of the side wall 44 of the housing. Branch line 324 comprises a shunt hose for supplying fluid to the other open end of the supply tube 94 as well as to conduit 266 for spray means 72. To that end, conduit 324 branches off into two branch conduits 330 and 332, with conduit 330 connected to the other open end of central supply tube 84, that is the end extending out of side wall 46, while conduit 332 is connected to conduit 266.

As can be seen, valve 312 is connected in line 324 and upstream of the branches 330 and 332. The pressure gauge 314 is connected in the system adjacent to the valve 312.

The conduit branch 328 serves as the means for bleeding off liquid from the system 300 upstream of all of the system's spray means. The valve 308 is provided in line 328 downstream of branch 322 to control the bleed off rate. The end of conduit 328 extends into the tank 56 for providing bleed off liquid therein. A return line 334 is connected between the sump screen 318 and the pump 304 for carrying liquid for reuse by the spraying means. The dump valve 316 is connected in a drain line 336 communicating with the bottom of the tank 56.

Operation of the fluid system 300 is as follows: The motor 302 is operative to drive a shaft 340 which in turn powers the pump 304. The pump 304 is operative to pump liquid from means (not shown) through line 320 to fluid filter 306. The fluid filter traps sediment and particles in the liquid and provides the filtered liquid into line 322 and hence into branch lines 324, 326 and 328. The valves 308 and 312 are set to predetermined positions to ensure that the pressure in lines 326 and 330 is maintained at a desired level. The pressure gauges 310 and 314 provide indications of the pressure existing in lines of the system.

As can be seen in FIG. 5B, a plug 342 is disposed within supply tube 94 intermediate openings 259 and 183 to thereby isolate the fluid supplied by conduit 326 to the first spray means 68 from the fluid supplied by conduit 330 to the second spray means 70.

In accordance with the preferred embodiments of this invention, the pressure of the liquid provided via conduit 326 to the spray means 68 is of the order of at least 200 pounds per square inch, whereas the pressure provided to the second spray means 70 and the third spray means 72, via lines 330 and 332, respectively, is of the order of at least 80 pounds per square inch. The reason for the higher fluid pressure of spray means 68 is that such spray means is used to spray the interior of the can and it is the interior of the can where most of the oil, film, particles, etc., produced during the formation operation are located. Hence, higher pressure is needed to clean the can's interior than its exterior. The flow rate of liquid to the spray means is also relatively high, e.g., 40 to 60 gallons per minute, minimum.

It is to be pointed out at this juncture that the forementioned pressures and flow rates relate to the first stage of the system, that is the unit for washing the cans. The remaining stages, which are constructed in an identical manner, operate at substantially lower pressures, e.g., 100 to 150 p.s.i. since it is easier, for example to rinse the cans than to wash them.

As noted heretofore, the bottom 54 of the housing 40 is open. This feature permits the liquid droplets produced in the housing during the spraying operation to drop through the open bottom of the housing for collection in tank 56. The sump screen 38 and connected return line 338 enable accumulated liquid in the tank to be recycled to the pump for reuse. The dump valve 316 is provided to enable the contents of the tank 56 to be drained, via drain pipe 336, when such action is desired.

In accordance with one aspect of this invention, the conveying means 32 works in conjunction with each of the units to effect the removal of the liquid of the preceeding stage from the surfaces of the cans. To that end, the conveyor means includes means (not shown) for reorienting the cans from their horizontal orientation at which they enter and leave the respective units of the systems (see FIG. 13) to a vertical orientation, wherein their open ends are facing downward, and for causing the cans to rotate about the vertical axis as they move along the conveyor to the next succeeding stage. By virtue of their downwardly extending orientation liquid is enabled to run out of the cans. In addition, the centripetal force caused by the rotating cans causes liquid droplets to be thrown off the cans.

The conveyor system also includes means (not shown) for effecting the wiping of the edge of the open end of the cans as the cans rotate and move along the conveyor to thereby effect a siphoning action on any liquid still adhering to the surface of the can. This action has the effect of removing residual liquid from the cans leaving only a thin liquid film on the cans, which dried evenly and quickly and without any residue spots.

As can be seen in FIG. 13, as the cans approach the next stage they are reoriented by the conveyor back to a horizontal attitude for entrance through inlet 34 of the next succeeding stage.

As should thus be appreciated the system of the instant invention includes individual stages, each of which is particularly suited for a successive can treating operation, although all of the units of the system have a common construction. In addition, the construction of each of the units is relatively simple, yet is effective for quickly and effectively treating all of the exterior and interior surfaces of cans as they pass through the units at a high rate os speed and without the danger of any jamming or misoperation. Furthermore, by virtue of the motion imparted to the cans by the carrier, drying occurs evenly with residue droplets being formed on the cans, thereby providing a much more evenly cleaned can that that produced by prior art systems.

It should be pointed out at this junction that while the system has been described as used for cleaning cans, it is to be understood that any container having a round circular wall can be cleaned or rinsed, or coated, or dryed utilizing the teachings of the instant invention and that any unit can be used either singly or in combination with other similar or different units depending upon the operations desired.

Without further elaboration, the foregoing will so fully illustrate my invention that others may, by applying current or future knowledge, readily adapt the same for use under various conditions of service.

What is claimed as the invention is:

1. Apparatus for spraying the surface of a plurality of open, cylindrical containers with a fluid at a high rate of speed, each of said containers having a side wall encircling the longitudinal axis of the container and an end wall at one end of said side wall, said apparatus comprising an enclosed housing, hollow carrier means disposed within said housing for receipt of said containers, a stationary raceway disposed about the periphery of said carrier means, said carrier means being rotatable about a first axis for carrying said containers from an inlet location in said housing through a circular orbit about said first axis to an outlet location in said housing, said containers making contact with said raceway to cause said containers to rotate on their respective axes as they move along said orbit, first spraying means including plural heads for spraying a fluid therefrom, each of said heads arranged to reciprocate into and out of a respective one of said open containers as said containers traverse said orbit to spray the interior surface of said side wall and said end wall, second spraying means mounted within said housing and arranged to spray said fluid in a radial direction with respect to said first axis and along a major portion thereof to spray the exterior surface of said side wall and third spraying means stationarily mounted within said housing and arranged to spray said fluid along a portion of the length of said orbit to spray the exterior surface of said end wall.

2. The apparatus of claim 1 wherein said second spraying means sprays in a radially outward direction with respect to said axis and through said carrier to spray the exterior surface of the side wall of said can.

3. The apparatus of claim 1 wherein said plural spray heads of said first means rotate about said first axis in unison with the rotation of said carrier means, while reciprocating into and out of said open containers, said reciprocation being effected by cam means including a circular peripheral edge lying in a plane skewed with respect to said first axis and wherein each of said spray heads comprises an elongated tube having a roller mounted thereon, rotatable about an axis parallel to said first axis and arranged for rolling along the periphery of said cam edge to effect the reciprocation of said spray heads.

4. The apparatus of claim 3 wherein means are provided to enable said first spray heads to spray said liquid only during a portion of the traversal of said orbit by said cans.

5. The apparatus of claim 4 wherein said portion of the traversal of the orbit is approximately 330°, starting approximately 25° after said cans enter said inlet location.

6. The apparatus of claim 3 wherein said second spray means includes a plurality of spray heads mounted for rotation about said first axis in unison with said carrier and directed radially outward from said axis and toward said orbit.

7. The apparatus of claim 6 wherein means are provided to enable the spray heads of the second spray means to spray only during a portion of said orbit.

8. The apparatus of claim 7 wherein the spray heads of said second spray means only spray when directed downward.

9. The apparatus of claim 8 wherein the spray heads of said third spray means spray said liquid only at the cans traversing a portion of the traversal of said orbit by said cans.

10. The apparatus of claim 9 wherein said portion of the traversal of the orbit is the lowermost portion.

11. The apparatus of claim 1 wherein said second spray means include a plurality of spray heads mounted about said first axis and directed radially outward therefrom and toward said orbit.

12. The apparatus of claim 11 wherein the spray heads of said second spray means are rotated about said first axis in unison with said carrier.

13. The apparatus of claim 12 wherein means are provided to enable the spray heads of said second spray means to spray only during a portion of said orbit.

14. The apparatus of claim 13 wherein the spray heads of said second spray means only spray when directed downwardly.

15. The apparatus of claim 1 wherein said third spray means comprises a plurality of spray heads mounted in an arcuate path opposite and parallel to said orbit.

16. The apparatus of claim 15 wherein said plural spray heads of said first means rotate about said first axis in unison with the rotation of said carrier means while reciprocating into and out of said open cans.

17. The apparatus of claim 1 additionally comprising conveyor means for carrying containers to be treated at a high rate of speed to said entrance location in said housing and for carrying treated containers at a high rate of speed from said exit location in said housing.

18. The apparatus of claim 17 additionally comprising injector means for causing said containers to enter said housing at said entrance location and into carrier at a higher rate of speed than the speed at which said containers are carried by said conveyor means and the speed at which they traverse said orbit and ejector means for carrying said containers to exit from said exit location and out of said carrier at a higher rate of speed than the speed at which said containers traverse said orbit.

19. The apparatus of claim 18 wherein said injector means and said ejector means comprise a rapidly circulating belt.

20. The apparatus of claim 19 additionally comprising guide means for guiding said cans into said recesses at said entrance location and out of said recesses at said exit location in conjunction with the operation of said rapidly circulating belt.

21. A system for treating the surface of a plurality of cans at a high rate of speed, each of said cans having a circular side wall encircling the longitudinal axis of the cans and an end wall at one end of the side wall, comprising first washing means for washing the interior and exterior surfaces of said cans, said first washing means comprising a housing, carrier means disposed within said housing for receipt of said cans and for carrying said cans from an inlet location in said housing through a circular orbit about a first axis to an outlet location in said housing, said cans rotating on their respective axes as they move along said orbit and first spraying means including plural spray heads for spraying a washing liquid therefrom, each head arranged to reciprocate into and out of said open containers as said containers traverse said orbit for washing the interior surface of said side wall and said end wall and second spraying means mounted within said housing and arranged to spray said washing liquid in a radial direction with respect to said axis for washing the exterior surface of said side wall and third spraying means stationarily mounted within said housing and arranged to spray said washing liquid along a portion of the length of said orbit to wash the exterior surface of said end wall, first conveyor means for carrying washed cans from said exit location of said first washing means to first rinsing means for rinsing the washed interior and exterior surfaces of said cans, said first rinsing means comprising a housing, carrier means disposed within said housing for receipt of said cans and for carrying said cans from an inlet location in said housing through a circular orbit about a first axis to an outlet location in said housing, said cans rotating on their respective axes as they move along said orbit, first spraying means including plural spray heads for spraying a rinsing liquid therefrom, each head arranged to reciprocate into and out of said open cans as said cans traverse said orbit for rinsing the interior surface of said side wall and said end wall, second spraying means mounted within said housing and arranged to spray said washing liquid in a radial direction with respect to said axis for rinsing the exterior surface of said side wall and third spraying means stationarily mounted within said housing and arranged to spray said rinsing liquid along a portion of the length of said orbit to rinse the exterior surface of said end wall and second conveyor means for carrying rinsed cans from the exit location of said first rinsing means.

22. The system of claim 21 additionally comprising coating means fed by said second conveyor means for applying a liquid coating to the interior and exterior surfaces of said rinsed cans, said coating means comprising a housing, carrier means disposed within said housing for receipt of said cans and for carrying said cans from an inlet location in said housing through a circular orbit about a first axis to an outlet location in said housing, said cans rotating on their respective axes as they move along said orbit, first spraying means including plural spray heads for spraying a coating liquid, each of said heads arranged to reciprocate into and out of a respective one of said open cans as said cans traverse said orbit for coating the interior surface of said side wall and end wall, and second spraying means mounted within said housing and arranged to spray said coating liquid in a radial direction with respect to said cans for coating the exterior surface of said side wall and third spraying means stationarily mounted within said housing and arranged to spray said coating liquid along a portion of the length of said orbit to coat the exterior surface of said end wall with said coating liquid and third conveyor means for carrying the coated cans from said exit location of said coating means.

23. The system of claim 22 additionally comprising drying means fed by said third conveyor means for drying the interior and exterior surfaces of said coated cans, said drying means comprising a housing, carrier means disposed within said housing for receipt of said cans and for carrying said cans from an inlet location in said housing through a circular orbit about a first axis to an outlet location in said housing, said cans rotating on their respective axes as they move along said orbit, first spraying means including plural spray heads for spraying a gas therefrom, each of said heads being arranged to reciprocate into and out of a respective one of said open cans as said cans traverse said orbit for drying the interior surface of said side wall and said end wall, second spraying means mounted within said housing and arranged to spray said gas in a radial direction with respect to said axis for drying the exterior surface of said side wall and third spraying means stationarily mounted within said housing and arranged to spray said gas along a portion of the length of said orbit to dry the exterior surface of said end wall as said cans move through said orbit.

* * * * *

UNITED STATES PATENT AND TRADEMARK OFFICE

CERTIFICATE OF CORRECTION

PATENT NO. : 4,051,805

DATED : October 18, 1977

INVENTOR(S) : John H. Waldrum

It is certified that error appears in the above-identified patent and that said Letters Patent are hereby corrected as shown below:

Column 7 Line 6 "raidus" should be --radius

Column 7 Line 14 "considerably" should be --considerable--.

Column 9 Line 16 "nozle" should be --nozzle--.

Column 14 Line 60 "84" should be 94--

Column 14 Line 67 "84" should be --94--.

Column 16 Line 16 "dried" should be --dries--.

Column 16 Line 35 the first --that-- should be --than--.

Claim 5 Line 30 "25°" should be --15°--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*